US006174145B1

(12) United States Patent
Taniguchi

(10) Patent No.: US 6,174,145 B1
(45) Date of Patent: Jan. 16, 2001

(54) AXIAL FLOW BLOWER DEVICE

(75) Inventor: Noboru Taniguchi, Miyota-machi (JP)

(73) Assignee: Minebea Co. Ltd., Nagano (JP)

( * ) Notice: Under 35 U.S.C. 154(b), the term of this patent shall be extended for 0 days.

(21) Appl. No.: 09/329,322

(22) Filed: Jun. 10, 1999

(30) Foreign Application Priority Data

Aug. 18, 1998 (JP) ..... 10-231400

(51) Int. Cl.[7] ..... F04B 17/00
(52) U.S. Cl. ..... 417/423.14
(58) Field of Search ..... 417/423.14, 423.1, 417/410.1, 321; 237/12.3 R; 55/282.3; 26/214

(56) References Cited

U.S. PATENT DOCUMENTS

| | | | | |
|---|---|---|---|---|
| 3,602,001 | * | 8/1971 | Bauer et al. | 62/3.5 |
| 3,733,502 | * | 5/1973 | Curtis et al. | 310/61 |
| 3,809,503 | * | 5/1974 | Schlicker et al. . | |
| 4,184,541 | * | 1/1980 | Beck et al. | 165/125 |
| 4,301,275 | * | 11/1981 | Heinze et al. | 528/500 |
| 4,362,540 | * | 12/1982 | Strahsner | 55/257.4 |
| 4,400,140 | * | 8/1983 | Papst | 417/354 |
| 4,514,655 | * | 4/1985 | Hosoya | 310/218 |
| 5,836,297 | * | 11/1998 | Kawasaki | 126/299 D |
| 5,916,255 | * | 6/1999 | Izumi et al. | 62/404 |

FOREIGN PATENT DOCUMENTS

| | | |
|---|---|---|
| U-4-16620 | 1/1992 | (JP) . |
| Y2-4-16620 | 4/1992 | (JP) . |

* cited by examiner

*Primary Examiner*—Teresa Walberg
*Assistant Examiner*—Daniel Robinson
(74) *Attorney, Agent, or Firm*—Oliff & Berridge, PLC

(57) ABSTRACT

A axial flow blower device has an improved in fixing structure for lead wires supplying electric current to a motor. A fan 9 driven by the motor 8 is provided at a central portion of a frame 1 the front and rear ends of which are constructed by two end plates 2,3. The two end plates 2,3 are arranged to secure the lead wires 10 supplying the electric current to the motor 8. Each of the end plates 2,3 has an opening 11 on its peripheral portions of said end plates 2,3 for insertion of the lead wires 10, and an insertion holes 15,16 extending obliquely from the opening 12 of the peripheral portions. One of the openings 12 is provided with a support groove 17 for supporting the lead wires 10 so that the support groove 17 forms an arcuate angle with respect to the one opening 12. The lead wires 10 passed through the insertion hole 15 can be supported by the support groove 17 when the lead wires 10 are twisted at an angle corresponding to the arcuate angle.

3 Claims, 4 Drawing Sheets

AXIAL FLOW BLOWER DEVICE

BACKGROUND OF THE INVENTION

1. Field of Invention

The present invention relates to an axial flow blower device which can be used for various purposes, for instance, for cooling an O.A. equipment, and the like.

2. Description of Related Art

A construction of an axial flow blower device, that is conventionally used, will be described with reference to FIG. 5. This construction is disclosed, for instance, in Japanese Utility Model Laid-open No. Hei 4-16620, or the like. A frame 1 includes end plates 2 and 3 opposite to each other and a connecting plate 4 connecting these end plates 2 and 3 together. The end plates 2 and 3 provide a circular hole 5 that forms a cylindrical wind tunnel of the frame 1. A circular motor mounting plate 6 is provided at a central portion of the end plate 2, and is supported by support members 7 projecting from portions of the end plates 2 to the motor mounting plate 6.

The motor supporting (mounting) plate 6 supports a bottom portion of an electrically driven motor 8, and a fan 9 is mounted on a rotary shaft (not shown) of this motor 8 so that the rotation of the fan 9 within the cylindrical wind tunnel of the frame 1 causes an air flow introduced from the end plate 2 side toward the end plate 3 side, or in its opposite direction.

Two lead wires 10 for supplying electric current to the motor 8 are extended to a surface of the support member 7 from a notch 7*a* formed on a portion of the support member 7, and inserted through openings 11 and 12 respectively provided on the end plates 2 and 3 into support grooves provided behind the openings 11 and 12, and then drawn rearwardly from the end plate 3 so that the lead wires 10 are connected to a power source. FIG. 6 shows the detail of a portion of the opening 11 in an enlarged manner, and FIG. 7 shows the detail of a portion of the opening 12 portion in an enlarged manner.

Behind the opening 11, a support groove 13 which allows the lead wires 10 to pass through the end plate 2 and which supports the outer periphery of the lead wires 10, and a guide groove 14 which guides the lead wires 10 from the support member 7 side to the support groove 13 side are provided. The width dimension of the opening 11 for the lead wires 10 is set so as to permit the single lead wire 10 to just pass through the opening 11 (that is, the width dimension is slightly larger than the outer diametric dimension of the single lead wire 10). The support groove 13 behind the opening 11 is in the form of a rectangle shape such that the vertical side is longer.

The opening 12 and the support groove 15 on the end plate 3 side as shown in FIG. 7 are similar in construction to the opening 11 and the support groove 13 on the end plate 2 side with the exception of the guide groove that is not provided on the end plate 3 side. That is, the support groove 15, which allows the lead wires 10 to pass through the end plate 3, which supports the outer periphery of the lead wires 10 and which is in the form of the vertical-side-longer rectangle shape, is provided behind the opening 11. On the end plate 3 side, the width dimension of the opening 12 for the lead wires 10 are similarly set so as to permit the single lead wire 10 to just pass therethrough.

In this construction, the wiring work of the lead wires 10 after the motor 8 is mounted onto the motor support plate 6 is carried out in the following manner: The lead wires 10 connected to the motor 8 are drawn out from the notch 7*a* of the support member 7 to the surface side of the end plate 2, and then extended on and along the support member 7 while being guided through the guide groove 14 so as to be positioned on the outer peripheral portion of the side plate 2. Thereafter, the two lead wires 10 are set horizontally so that the height thereof corresponds to the height of the single lead wire, and then passed through the opening 11 of the end plate 2 and the opening 12 of the end plate 3 simultaneously. Subsequently to that, the two lead wires 10 are twisted 90 degrees so as to be supported by the support grooves 13 and 15. FIG. 8 shows a state of the lead wires 10 which have been inserted into and supported by the support grooves 13 and 15 in this manner.

In the construction described above, when the lead lines 10 are inserted into the openings 11 and 12, since each of the openings 11 and 12 has the width dimension corresponding only to the single lead wire, the lead wires 10 can not be inserted into the openings 11 and 12 unless the lead wires 10 guided by the guide groove 14 are twisted 90 degrees. The lead wires 10 in the twisted state are passed through the openings 11 and 12 and moved into the supported grooves 13 and 15 where the lead wires 10 are twisted 90 degrees again. This is caused by the guide groove 14 and the support grooves 13 and 15 having shapes which are elongate in the same direction, as well as by the openings 11 and 12 which are open in a direction perpendicular to the elongating direction and which correspond in height only to the single lead wire 10.

Therefore, there arises a problem in which the passage of the lead wires 10 through the openings 11 and 12 may cause the damage on sheathes of the lead wires 10. The openings 11 and 12 can be made larger to prevent the damage on the lead wires 10, but as the openings 11 and 12 are made larger, the lead wires 10 cannot be sufficiently supported within the support grooves 13 and 15, so that there arises another problem in which the lead wires 10 are likely to be removed externally from the openings 11 and 12.

SUMMARY OF THE INVENTION

The present invention was made in view of these problems. It is an object of the present invention to provide an axial flow blower device, which can improve the workability for supporting lead wires at the openings, and which can facilitate the support for the lead wires without any damages on sheaths of the lead wires.

In order to solve the above-mentioned problems, according to a first aspect of the present invention, there is provided an axial flow blower device having a frame provided with end plates opposite from each other to form a wind tunnel between the end plates, a motor supported by support members projecting from one side surface of the end plate toward a central portion of the wind tunnel, and lead wires connected to the motor. The axial flow blower device according to a first aspect of the present invention is characterized by including: openings respectively provided on peripheral portions of the end plates for insertion of the lead wires; insertion holes extending respectively obliquely from the openings of the peripheral portions; and a support groove provided on at least one of the insertion holes for supporting the lead wires.

According to a second aspect of the present invention, an axial flow blower device of the first aspect of the present invention is characterized in that a width of the insertion holes is larger than a width in the case where the plural lead wires are aligned in a row.

According to a third aspect of the present invention, an axial flow blower device of the first aspect of the present invention is characterized in that one of the insertion holes and the support groove communicating with the one insertion hole cooperatively form an acute angle or a substantially V-shape.

In these arrangements, the lead wires inserted through the openings advance along the insertion holes extending obliquely with respect to the peripheral portions, and by inclining the lead wires with a small angle, so that the lead wires are supported by the support groove provided on at least one of the openings.

DETAILED DESCRIPTION OF PREFERRED EMBODIMENTS

Figure 1:
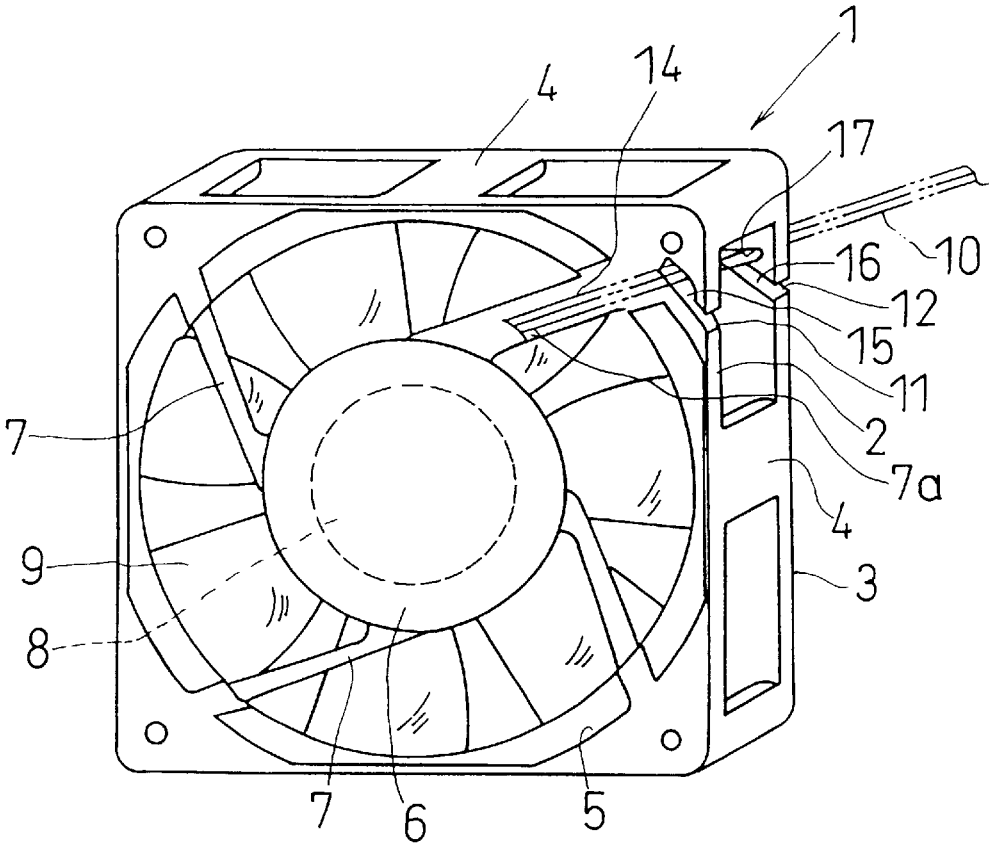
FIG. 1 is a perspective view of an embodiment of the present invention.

A preferred embodiment of the present invention will be described with reference to FIGS. 1 to 4 which respectively correspond to FIGS. 5 to 8 showing the conventional blower device construction. Similarly to the conventional blower device, in a blower device of the present invention, a frame 1 includes two end plates 2 and 3 opposite to each other and a connecting plate 4 connecting these end plates 2 and 3 together, and the end plates 2 and 3 provide a circular hole 5 that forms a cylindrical wind tunnel of the frame 1. Further, the blower device of present invention also adopts the same construction in which a circular motor mounting plate 6 is provided at a central portion of the end plate 2, that is supported by support members 7 projecting from portions of the end plates 2 to the motor mounting plate 6. Similarly, the motor supporting (mounting) plate 6 supports a bottom portion of an electrically driven motor 8, and a fan 9 is mounted on a rotary shaft (not shown) of this motor 8 so that the rotation of the fan 9 within the cylindrical wind tunnel of the frame 1 causes an air flow introduced from the end plate 2 side toward the end plate 3 side, or in its opposite direction.

The present invention is characterized in that insertion holes extending obliquely from the openings of each end plate to which the lead wires are inserted to the peripheral portions thereof are provided, and that a support groove for supporting the lead wires is provided on at least one of the openings. Further, the length of each insertion holes is set to be larger than a width in the case where a plurality of the lead wires are aligned in a row. Furthermore, the insertion hole and the support groove communicating with this insertion hole cooperatively form an acute angle, or a substantially V-shape. Portions other than these portions are similar in construction to those described with reference to FIGS. 5 to 8.

The features of the present invention will be described with reference to FIGS. 1 to 4. The openings 11 and 12 that are provided for the lead wires on the peripheral portions of the end plates 2 and 3 are similar to those of the conventional device described with reference to FIGS. 5 and 8 as a whole. However, the insertion holes 15 and 16 are provided, which are the cuts extending inwardly and obliquely from the openings 11 and 12, respectively. The width of each of the openings 11 and 12 is set to be larger than the width of the single lead wire 10, and the width of the each of the insertion holes 15 and 16 is set to be larger than the width of the plurality of the lead wires 10 aligned in a row (two lead wires 10 in this embodiment).

Figure 2:
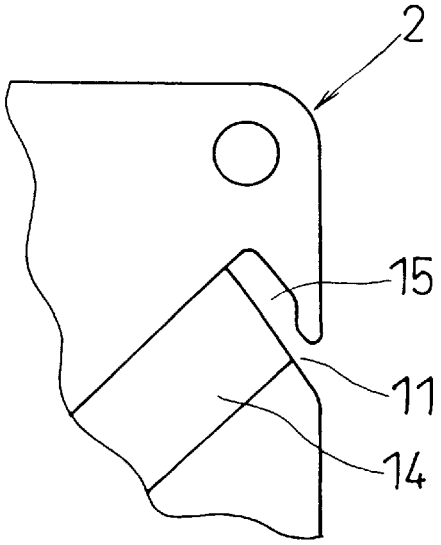
FIG. 2 is a front view showing a major portion of FIG. 1, which is a portion of an end plate located at a front side.
Figure 3:
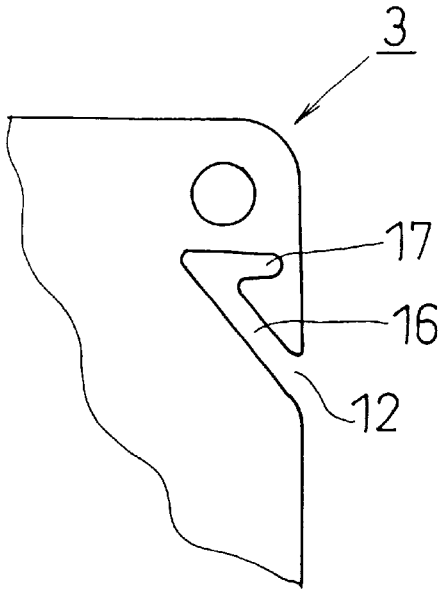
FIG. 3 is a front view showing a major portion of FIG. 1, which is a portion of an end plate located at a rear side.

The insertion holes 15 and 16 provided respectively in the two end plates 2 and 3 are directed obliquely upwardly from the openings 11 and 12 as illustrated in the drawings. That is, the lead wires 10 which are inserted through the openings 11 and 12 are adapted to be moved obliquely upwardly. As shown in FIGS. 1 to 4, when the lead wires 10 are positioned at the deepest portions of the insertion holes 15 and 16, the lead wires 10 meet the outer end portion of the support member 7 provided with the notch 7*a* and the guide groove 14. In addition, as shown in FIG. 2, the height of the insertion hole 15 is larger than that of the opening 11.

Of the two end plates 2 and 3, the rear end plate 3 is provided with a support groove 17 which supports the lead wires 10 so as to communicate with the insertion hole 16. The insertion hole 16 and the support groove 17 cooperatively form an acute angle or a substantially V-shape. The support groove 17 is set to be larger in sectional area than the plurality of lead wires bundled together.

In this construction, the wiring work of the lead wires 10 after the motor 8 is mounted onto the motor support plate 6 is carried out in the following manner: The lead wires 10 connected to the motor 8 are drawn out from the notch 7*a* of the support member 7 so as to be exposed on the surface side of the end plate 2, and then extended on and along the support member 7 while being guided by the guide groove 14 so as to be positioned on the outer peripheral portion of the side plate 2. Thereafter, the two lead wires 10 arranged in parallel are set horizontally so that the height thereof corresponds to the height of the single lead wire, and then passed obliquely upwardly through the opening 11 of the end plate 2 and the opening 12 of the end plate 3 simultaneously. Subsequently to the passage, portions of the two lead wires 10, that are located at the end plate 3, are twisted about 30 degrees so as to be inserted into and supported by the support grooves 17.

Figure 4:
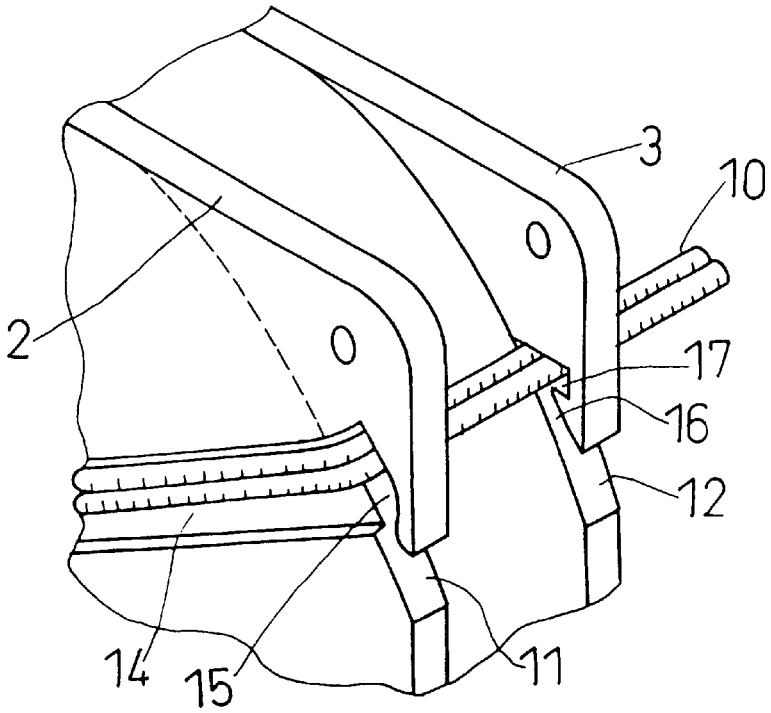
FIG. 4 is a enlarged perspective view showing a major portion of FIG. 1.
Figure 5:
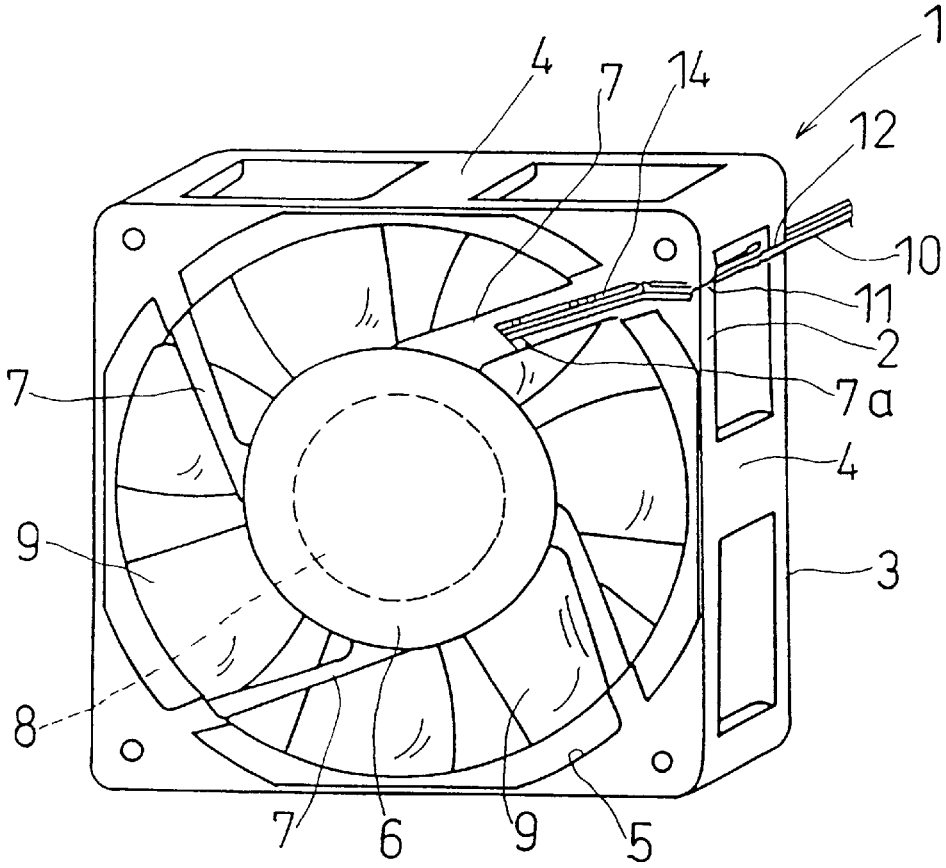
FIG.5 Prior Art
FIG. 5 is a perspective view showing a conventional construction of an axial flow blower device.
Figure 6:
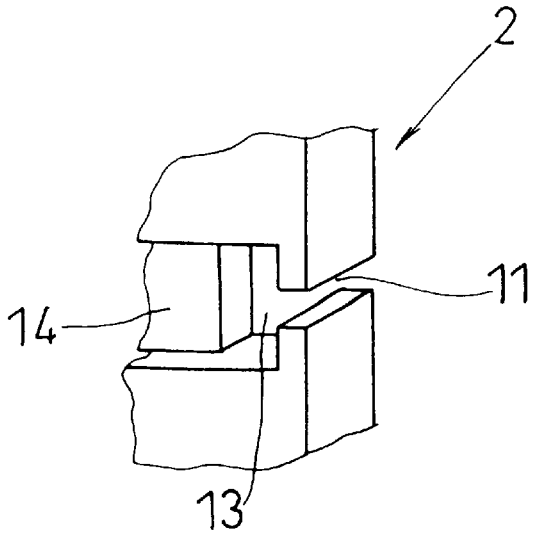
FIG.6 Prior Art
FIG. 6 is a front view showing a major portion of FIG. 5, which is a portion of an end plate located at a front side.
Figure 7:
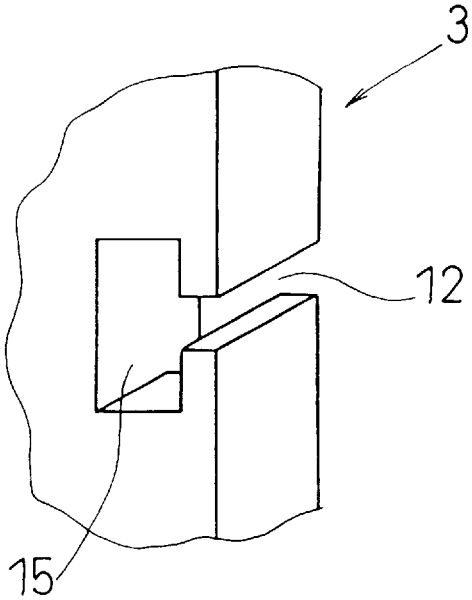
FIG.7 Prior Art
FIG. 7 is a front view showing a major portion of FIG. 5, which is a portion of an end plate located at a rear side.
Figure 8:
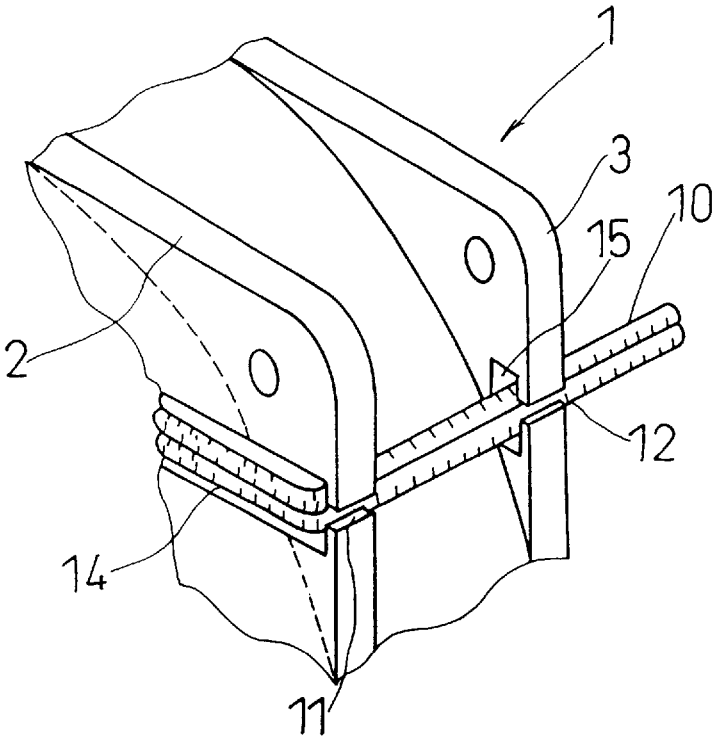
FIG.8 Prior Art
FIG. 8 is an enlarged perspective view of a major portion of FIG. 5.

Consequently, the lead wires 10 are extended from the support groove 17 and drawn out rearwardly with respect to the end plate 3, so as to be connected to a power supply (not shown). FIG. 4 shows a state in which the lead wires 10 have been passed through and supported by the support groove 17.

As described above, the width of each of the openings 11 and 12 is set to be larger than the width of the single lead wire 10, and the insertion holes 15 and 16 in the form of cuts obliquely and inwardly extending into the end plates 2 and 3 from their peripheral portions are oriented at an angle substantially the same as an angle of the lead wires 10 guided by the guide groove 14. Thus, the lead wires 10 can be slidably inserted without applying any twists thereto. This can facilitate the insertion of the lead wires 10 into the openings 11 and 12 without applying any damages to sheaths of the lead wires 10. In addition, even if the openings 11 and 12 are larger in width than the single lead wire 10, the lead wires 10 cannot be removed through the openings 11 and 12 as long as the insertion holes 15 and 16 are set to be larger in width than the lead wires 10 aligned in a row.

The insertion hole 16 provided on the end plate 3 side and the support groove 17 communicating with this insertion hole 16 cooperatively form an acute angle or a substantially V-shape, and the cross-sectional area of the support groove 17 is set to be larger than the cross-sectional area of the plurality of the lead wires 10 that are bundled together. This can surely support the lead wires 10 by the support groove 17, and therefore can permit the length of the insertion hole 16 to be set shorter than the width of the plurality of the lead wires 10 aligned in a row.

Although the support groove 17 is provided on one of the two end plates 2 and 3 in the above-described embodiment, two support grooves 17 may be provided on both of the two side plates 2 and 3 opposite to each other. In a case where the grooves 17 are provided on both of the two side plates 2 and 3, it is preferable, in view of removal preventing purpose, to set the support grooves 17 to have respective different hole angles with respect to the insertion holes 15 and 16.

The axial flow blower device of the present invention constructed as described above can eliminate the need of twisting the lead wires 90 degrees when the lead wires are supported using the notched portions of the end plates. Therefore, the sheaths of the lead wires are prevented from being damaged. Further, it is possible to surely support the lead wires without the generally required twice twisting operations, thereby remarkably facilitating the work therefor.

What is claimed is:

1. An axial flow blower device having a frame provided with end plates opposite from each other to form a wind tunnel between said end plates, a motor supported by support members projecting from one side surface of said end plate toward a central portion of said wind tunnel, and lead wires connected to said motor, comprising:

openings provided on each peripheral portion of said end plates for insertion of said lead wires;

insertion holes extending respectively obliquely from said openings of said peripheral portions; and a support groove provided on at least one of said insertion holes for supporting said lead wires.

2. An axial flow blower device according to claim 1, wherein a width of each of said insertion holes is larger than a width of said plural lead wires aligned in a row.

3. An axial flow blower device according to claim 1, wherein one of said insertion holes and said support groove communicating with said one insertion hole cooperatively form an acute angle.

* * * * *